US012185851B2

(12) United States Patent
Cox et al.

(10) Patent No.: US 12,185,851 B2
(45) Date of Patent: Jan. 7, 2025

(54) REVISED IMPROVED PICTURE HANGING APPLIANCE

(71) Applicant: Hang EzE LLC, Eufaula, OK (US)

(72) Inventors: Donald Cox, Porum, OK (US); Mike Idleman, Eufaula, OK (US)

(73) Assignee: Hang EzE LLC, Eufaula, OK (US)

( * ) Notice: Subject to any disclaimer, the term of this patent is extended or adjusted under 35 U.S.C. 154(b) by 451 days.

(21) Appl. No.: 17/729,855

(22) Filed: Apr. 26, 2022

(65) Prior Publication Data

US 2022/0354280 A1 Nov. 10, 2022

Related U.S. Application Data

(60) Provisional application No. 63/276,435, filed on Nov. 5, 2021, provisional application No. 63/183,665, filed on May 4, 2021.

(51) Int. Cl.
*A47G 1/20* (2006.01)

(52) U.S. Cl.
CPC ..... *A47G 1/205* (2013.01)

(58) Field of Classification Search
CPC ..... A47G 1/205
USPC ..... 33/451, 484, 485, 613, 645
See application file for complete search history.

(56) References Cited

U.S. PATENT DOCUMENTS 3,530,591 A * 9/1970 Moffitt ..... A47G 1/205 33/613
4,241,510 A * 12/1980 Radecki ..... G01B 3/02 33/474
4,399,616 A * 8/1983 Jansson ..... G01B 3/08 33/809
4,648,185 A * 3/1987 Brandimarte ..... B25H 7/04 33/669
5,255,885 A * 10/1993 Iversen ..... A47G 1/1606 248/220.22
5,471,760 A * 12/1995 Farris ..... A47G 1/205 33/613
6,029,362 A * 2/2000 Miodragovic ..... B25H 7/00 33/483
6,032,378 A * 3/2000 Null ..... A47G 1/205 33/645
6,421,928 B1 * 7/2002 Miller ..... A47G 1/205 33/669
6,471,175 B1 * 10/2002 Kratish ..... A47G 1/205 40/713
6,473,983 B1 * 11/2002 Gier ..... A47G 1/205 33/613
6,739,065 B2 * 5/2004 Hofmeister ..... A47G 1/205 33/666
8,347,518 B1 * 1/2013 Martinez ..... A47G 1/205 33/645
8,539,691 B2 * 9/2013 Daniel ..... F16M 11/105 33/645
8,840,080 B1 * 9/2014 Gordon ..... F16M 13/02 248/544

(Continued)

*Primary Examiner* — George B Bennett

(74) *Attorney, Agent, or Firm* — William Lovin & Associates LLC; William R. Lovin

(57) ABSTRACT

A device used to easily assist an individual in hanging a picture, photo, or award, when framed, on a wall or other vertical surface, such that the picture, photo, or award is level is disclosed. The device may be constructed of plastic, fiber reinforced cloth, or metal.

12 Claims, 2 Drawing Sheets

(56) References Cited

U.S. PATENT DOCUMENTS

| | | | | |
|---|---|---|---|---|
| 8,864,095 | B1 * | 10/2014 | Marks | A47G 1/16<br>248/323 |
| 9,151,441 | B2 * | 10/2015 | Wheeler | A47G 1/1613 |
| 9,642,478 | B1 * | 5/2017 | Tanger | A47G 1/164 |
| 9,986,857 | B2 * | 6/2018 | Bornstein | B25H 7/00 |
| 10,004,344 | B1 * | 6/2018 | Williams | A47G 1/205 |
| 10,716,416 | B1 * | 7/2020 | Harrington | A47G 1/205 |
| 11,064,823 | B2 * | 7/2021 | Ulloa | A47G 1/205 |
| 11,156,736 | B1 * | 10/2021 | De La Torre | G01C 15/004 |
| 11,255,651 | B2 * | 2/2022 | Medina | G01C 9/34 |
| 11,547,223 | B1 * | 1/2023 | Hassett | A47G 1/17 |
| 11,781,850 | B1 * | 10/2023 | Marshall | G01B 5/14<br>33/301 |
| 2004/0221463 | A1 * | 11/2004 | Hexamer, Jr. | G01B 3/10<br>33/365 |
| 2016/0279787 | A1 * | 9/2016 | Miller | B25H 7/04 |
| 2021/0277665 | A1 * | 9/2021 | Bilge | E04F 13/081 |
| 2022/0287482 | A1 * | 9/2022 | Malott | A47G 1/1626 |

* cited by examiner

REVISED IMPROVED PICTURE HANGING APPLIANCE

CROSS-REFERENCE TO RELATED APPLICATIONS

This application makes reference to U.S. Prov. App. No. 63/183,665 dated May 4, 2021, and U.S. Prov. App. No. 63/276,435 dated Nov. 5, 2021, and incorporates both of those applications, in their entirety, by reference.

FIELD OF THE INVENTION

The present disclosure deals with devices used to assist an individual in hanging a picture, photo, or award, when framed, on a wall or other vertical surface such that the picture, photo, or award is level.

BACKGROUND OF THE INVENTION

Pictures, photos, and awards have been hung from walls for hundreds, if not thousands, of years. The problem is that most of these items are designed so that they appear best when hung level. Thus, a broad range of tools have been implemented to assist the user in hanging pictures, photos, and awards so that they are level. Whether levels to be placed on the outside of the frame, or solid steel strips such as rulers with levels affixed to them, or a tape measure and pencil, such devices have been in use for centuries.

What is needed is a device that assists in the hanging of pictures, photos, or awards that is compact and flexible, in one long dimension, such that the device may be rolled up and stored in a compact storage area or pocket.

Also, what is needed is a device that allows the user to affix as many hanging devices (hooks, nails, screws, etc.) as the user desires.

Also, what is needed is a device that may be applied to the mounting points of the hanging strap affixed to the back of framed pictures, photos, or awards and then transferred and leveled on the wall or other vertical surface which marks where the hanging devices (hooks, nails, screws, etc.) are to be installed so the picture, photo, or award may be hung level.

Also, what is needed is a device that may be applied to the pre-drilled mounting points on the back of framed pictures, photos, or awards and then transferred and leveled on the wall or other vertical surface which marks where the hanging devices (hooks, nails, screws, etc.) are to be installed so the picture, photo, or award may be hung level.

BRIEF SUMMARY OF THE INVENTION

The invention consists of a thin strip of material, flexible in the lengthwise vertical direction, equipped with a slidable unit containing a spirit level. The thin strip of material may be cloth or canvas such as tricot or rigid fabric sewn, or pressure treated, or immersed in latex or silastic to increase its height wise rigidity without compromising is lengthwise flexibility. Also, the thin strip may be constructed of thin plastic. Also, the thin strip might be constructed of thin metal pierced periodically along the central axis of the length of the thin strip. The thin strip might be about 26-gauge metal. Linearly aligned along the central axis of the length of the thin strip of material are a series of impressed filled circles, ovals, squares, or rectangles. These impressed areas are included to increase the rigidity of the thin strip in the lengthwise, vertical direction. Also, linearly aligned along the central axis of the length of the thin strip of material is a printed line. Included with the invention are at least two thumbtacks or pushpins (locator pins). In an alternative embodiment of the invention the two thumbtacks or pushpins (locator pins) may be mounted in slidable units so that they are securely slid over the thin strip of flexible material The spirit level is included in a slidable unit so that it is securely slid over the thin strip of flexible material. In an alternative embodiment of the invention, the slidable unit the spirit level is included on is mounted to the thin strip between the two slidable units that have thumbtacks or pushpins (locator pins) mounted on them. The spirit level is preferentially located in the slidable unit above the thin strip of flexible material but may be below it.

The invention may be rolled up lengthwise and stored in a box or pocket. Velcro®, or some other releasable securing mechanism, may be affixed to opposite sides of either end of the thin strip of material and used to secure the thin strip of material in the rolled condition.

The invention is used in the following manner: First, the invention is unrolled. Next, the invention is placed so that locator pins may be inserted through the thin strip, on the line printed on the thin strip, such that the tips of the locator pins are positioned where the hang strap or wire of the picture, photo, or award terminates on the left and right side of the picture, photo, or award. As many other locator pins may be inserted through the thin strip, on the line printed on the thin strip (or through the holes pierced periodically along the long central axis of the thin strip), as desired. Also, pictures, photos, or awards may be provided with frames or other structures with pre-drilled holes on either side. The locator pins may be inserted in these pre-drilled holes. The slidable unit and the spirit level, is preferably, between the termination points of the hang strap or wire or the pre-drilled holes. Next, after the locator pins are inserted through the thin strip, the invention is then transported to a wall or other vertical surface and is aligned such that the thin strip is horizontal, as indicated by the spirit level. Next, the locator pins are inserted slightly into the wall or other vertical surface. Next, hanging devices (such as hooks, nails, screws, etc.) are inserted at the location where the locator pins were inserted into the wall. Finally, the picture, photo, or award is hung by its hang strap from the hanging devices.

DETAILED DESCRIPTION OF THE INVENTION

Figure 1:
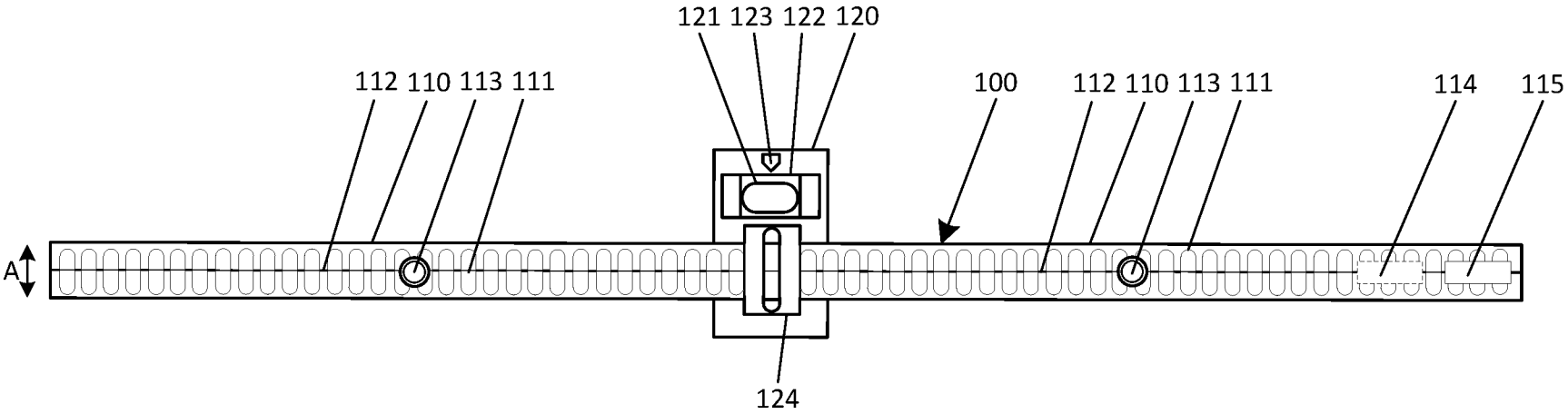
FIG. 1 is an elevation view of the invention, unrolled, as it would be when applied to the back of a picture, photo, or award or to the wall or other vertical surface upon which the picture, photo, or award is to be hung. In this embodiment of the invention, the thumbtacks or pushpins (locator pins) are inserted through the thin strip outboard of the spirit level mounted in the center slidable unit.

Referring now to FIG. 1, the invention 100 consists of a thin strip 110 of rollable material, inflexible in dimension A, equipped with a slidable unit 120 containing a spirit level 122. The thin strip 110 of material may be cloth or canvas such as tricot or rigid fabric sewn, or pressure treated, or immersed in latex or silastic to increase its heightwise rigidity without compromising is lengthwise flexibility. Also, the thin strip 110 of material may be constructed of thin plastic. Also, the thin strip 110 might be constructed of thin metal pierced periodically along the central axis of the length of the thin strip 110. The thin strip 110 might be about 26-gauge metal. Linearly aligned along the central axis of the length of the thin strip 110 of material may be a series of impressed areas 111 such as filled circles, ovals, squares, or rectangles. These impressed areas 111 are included to increase the rigidity of the thin strip 110 in dimension A. Also, linearly aligned along the central axis of the length of the thin strip 110 of material is a printed straight line 112. Included with the invention are at least two thumbtacks or pushpins (locator pins 113).

The spirit level 122 is included in a slidable unit 120 that has a surmounted pass-through block 124 through which the thin strip 110 of flexible material securely slides. The spirit level 122 is preferentially located in the slidable unit 120 above the thin strip 110 of flexible material but may be below it. Also, molded or printed centered above (or below) the spirit level 122 is a centering arrow 123. The centering arrow aids the user in using the spirit level 122.

The invention 100 may be rolled up lengthwise and stored in a box or pocket. Velcro® or some other releasable securing mechanism, may be affixed to opposite sides 114 and 115 of either end of the thin strip 110 of material and used to secure the thin strip 110 of material in the rolled condition.

The invention 100 is used in the following manner: First, the invention 100 is unrolled. If Velcro® or some other releasable securing mechanism, is affixed to opposite sides 114 and 115 at one end of the invention 100, the Velcro® or other releasable securing mechanism is first released. Next, the invention 100 is placed so that locator pins 113 may be inserted through the thin strip 110, on the printed straight line 112 printed on the thin strip 110, such that the tips of the locator pins 113 are positioned where the hang strap or wire of the picture, photo, or award terminates on the left and right side of the picture, photo, or award. As many other locator pins 113 may be inserted through the thin strip 110, on the printed straight line 112 on the thin strip 110, as desired. Also, pictures, photos, or awards may be provided with frames or other structures with pre-drilled holes on either side. The locator pins 113 may be inserted in these pre-drilled holes. The slidable unit 120 and the spirit level 122, is preferably, between the termination points of the hang strap or wire or the pre-drilled holes. Next, after the locator pins 113 are inserted through the thin strip 110, the invention 100 is then transported to a wall or other vertical surface and is aligned such that the thin strip 110 is horizontal, as indicated by the spirit level 122. This is done by aligning the spirit level 122 such that the bubble 121 in the spirit level 122 is equidistant from either end of the spirit level 122 and centered directly under the centering arrow 123. Next, the locator pins 113 are inserted slightly into the wall or other vertical surface. Next, hanging devices (such as hooks, nails, screws, etc.) are inserted at the location where the locator pins 113 were inserted into the wall. Finally, the picture, photo, or award is hung by its hang strap or wire or other mechanism from the hanging devices.

Figure 2:
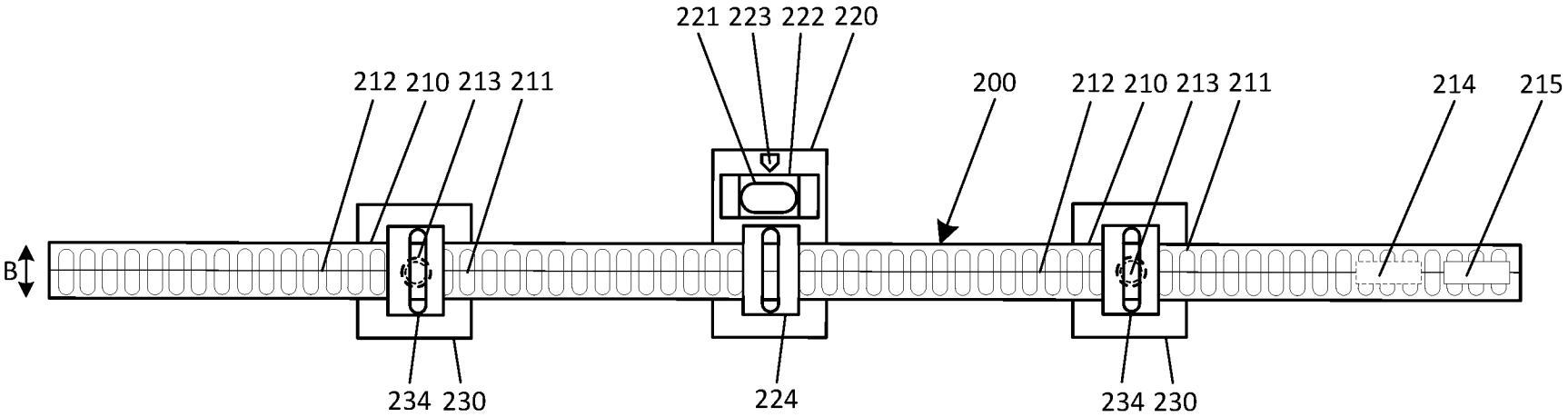
FIG. 2 is an elevation view of the invention, unrolled, as it would be when applied to the back of a picture, photo, or award or to the wall or other vertical surface upon which the picture, photo, or award is to be hung. In this embodiment of the invention, the thumbtacks or pushpins (locator pins) are mounted to the reverse side of the slidable units affixed to the thin strip outboard of the spirit level mounted in the center slidable unit.

Referring now to FIG. 2, the invention 200 consists of a thin strip 210 of rollable material, inflexible in dimension B, equipped with a slidable unit 220 containing a spirit level 222. The thin strip 210 of material may be cloth or canvas such as tricot or rigid fabric sewn, or pressure treated, or immersed in latex or silastic to increase its height wise rigidity without compromising is lengthwise flexibility. Also, the thin strip 210 of material may be constructed of thin plastic. Also, the thin strip 210 might be constructed of thin metal pierced periodically along the central axis of the length of the thin strip 210. The thin strip 210 might be about 26-gauge metal. Linearly aligned along the central axis of the length of the thin strip 210 of material may be a series of impressed areas 211 such as filled circles, ovals, squares, or rectangles. These impressed areas 211 are included to increase the rigidity of the thin strip 210 in dimension B. Also, linearly aligned along the central axis of the length of the thin strip 210 of material is a printed straight line 212. Included with the invention are at least two thumbtacks or pushpins (locator pins 213) inserted into the reverse side of independent slidable units 230. Independent slidable units 230 are mounted lateral to (outboard of) slidable unit 220 on thin strip 210 by means of surmounted pass-through blocks 234 through which the thin strip 210 of flexible material securely slides.

The spirit level 222 is included in a slidable unit 220 that has a surmounted pass-through block 224 through which the thin strip 210 of flexible material securely slides. The spirit level 222 is preferentially located in the slidable unit 220 above the thin strip 210 of flexible material but may be below it. Also, molded or printed centered above (or below) the spirit level 222 is a centering arrow 223. The centering arrow aids the user in using the spirit level 222.

The invention 200 may be rolled up lengthwise and stored in a box or pocket. Velcro® or some other releasable securing mechanism, may be affixed to opposite sides 214 and 215 of either end of the thin strip 210 of material and used to secure the thin strip 210 of material in the rolled condition.

The invention 200 is used in the following manner: First, the invention 200 is unrolled. If Velcro® or some other releasable securing mechanism, is affixed to opposite sides 214 and 215 at one end of the invention 200, the Velcro® or other releasable securing mechanism is first released. Next, the invention 200 is placed so that locator pins 213 may be located such that the tips of the locator pins 213 are positioned where the hang strap or wire of the picture, photo, or award terminates on the left and right side of the picture, photo, or award. Also, pictures, photos, or awards may be provided with frames or other structures with pre-drilled holes on either side. The locator pins 213 may be inserted in these pre-drilled holes. The slidable unit 220 and the spirit level 222, is preferably, between the termination points of the hang strap or wire or the pre-drilled holes. Next, after the locator pins 213 are located at the proper distance from one another, the invention 200 is then transported to a wall or other vertical surface and is aligned such that the thin strip 210 is horizontal, as indicated by the spirit level 222. This is done by aligning the spirit level 222 such that the bubble 221 in the spirit level 222 is equidistant from either end of the spirit level 222 and centered directly under the centering arrow 223. Next, the locator pins 213 are inserted slightly into the wall or other vertical surface. Next, hanging devices (such as hooks, nails, screws, etc.) are inserted at the location where the locator pins 213 were inserted into the wall. Finally, the picture, photo, or award is hung by its hang strap or wire or other mechanism from the hanging devices.

Alternative embodiments of the present invention 100 or 200 include the following features: 1) The thin strip 110 or 210 may be constructed of polyester cloth with a plum line sewn or printed in the central area of the thin strip 110 or 210 so that the thin strip 110 or 210 is flexible and may be carried folded over the shoulder for better hand use without loss of settings; 2) The invention 100 or 200 may be rolled up and carried in a tool bag; 3) The cloth or paper portions of invention 100 or 200 may be dyed different colors; 4) The invention 100 or 200 may be written on with a marker to customize measurements.

Also: 1) The two thumbtacks or pushpins (locator pins 213) are ordinarily #8 ⅜" screws so if damaged or dulled they may be easily replaced; 2) If the two thumbtacks or pushpins (locator pins 213) need to be longer because one is working around an object (such as a wall mounted electrical or plumbing conduit) then a longer #8 screw may be used; 3) When made of cloth, plastic, or fibrous cloth the thin strip 110 or 210 may bend without damage unlike a metal or wooden strip; 4) Pushpins 113 may not be moved accidently, they must be manually moved and reinserted through the thin strip 110; 5) Independent slidable units 230 surmounted by pass-through blocks 234 will not randomly slide on their own. They must be physically moved because the pass-through blocks 234 adhere to a cloth, plastic, or fibrous cloth thin strip 210; 6) Alternative embodiments of the present invention 100 or 200 possess no mechanical system that can break down or malfunction like a spring loaded tape measure; and, 7) Alternative embodiments of the present invention 100 or 200 may have a storage hole at either, or both, ends of the thin strip to hang the present invention 100 or 200 on a hanger or shop pin.

What is claimed is:

1. An improved picture hanging appliance wherein the appliance comprises:

a) a thin strip of manually rollable flexible material that is inflexible laterally across its long axis;

b) wherein the thin strip of manually rollable flexible material has a multiplicity of impressed regions regularly formed in its surface;

c) a central slidable unit that it is slid over the thin strip of manually rollable flexible material;

d) a spirit level installed horizontally in the central slidable unit such that the spirit level is parallel to the long dimension of the thin strip of manually rollable flexible material; and e) two lateral slidable units each one of which is slid over the thin strip of manually rollable flexible material on either side of the central slidable unit wherein each lateral slidable unit has a locator pin projecting at right angles from its reverse side.

2. An improved picture hanging appliance of claim 1 where the manually rollable flexible material that is inflexible laterally across its long axis is plastic.

3. An improved picture hanging appliance of claim 1 where the manually rollable flexible material that is inflexible laterally across its long axis is fiber reinforced cloth.

4. An improved picture hanging appliance of claim 1 where the manually rollable flexible material that is inflexible laterally across its long axis is metal strip.

5. An improved picture hanging appliance of claim 1 where the manually rollable flexible material that is inflexible laterally across its long axis is 26-gauge sheet steel strip.

6. An improved picture hanging appliance of claim 1 wherein the locator pin is a pushpin.

7. An improved picture hanging appliance of claim 1 wherein the locator pin is a thumbtack.

8. An improved picture hanging appliance of claim 1 wherein the locator pin is a screw.

9. An improved picture hanging appliance of claim 1 wherein the locator pin is a nail.

10. An improved picture hanging appliance of claim 1 wherein the central slidable unit has a printed or molded marking at its centermost part to aid the user in determining when the spirit level shows level.

11. An improved picture hanging appliance wherein the appliance comprises:

a) a thin strip of manually rollable flexible material that is inflexible laterally across its long axis;

b) wherein the thin strip of manually rollable flexible material has a multiplicity of transverse impressed regions regularly formed in its surface;

c) wherein the thin strip of manually rollable flexible material has a printed line on its outside surface wherein the line is colinear with the long axis of the thin strip of manually rollable material;

d) a central slidable unit that it is slid over the thin strip of manually rollable flexible material;

e) a spirit level installed horizontally in the central slidable unit such that the spirit level is parallel to the long dimension of the thin strip of manually rollable flexible material; and f) two locator pins each one of which is inserted through the thin strip of manually rollable flexible material on the printed line projecting at right angles from its reverse side.

12. A method of using an improved picture hanging appliance of claim 1 comprising the following steps:

a) unrolling the appliance;

b) placing the appliance across the back of a framed article such that the locator pins touch the framed article where the hang strap or wire terminates at its right and left end;

i. whereupon the appliance is removed from the back of the framed article and transported to the wall or other vertical structure;

ii. whereupon the appliance is placed at the proper height on the wall or other vertical structure;

iii. whereupon the appliance is leveled using the spirit level and the at least two locator pins are pushed into the wall or other vertical structure after the appliance is leveled;

iv. whereupon the at least two locater pins are removed from the wall or other vertical structure;

v. whereupon picture hanging devices are installed where the locator pins were inserted into the wall or other vertical structure; and c) hanging the framed article.

* * * * *